US007971428B2

(12) United States Patent
Kimura et al.

(10) Patent No.: US 7,971,428 B2
(45) Date of Patent: Jul. 5, 2011

(54) EXHAUST GAS PURIFICATION DEVICE FOR INTERNAL COMBUSTION ENGINE

(75) Inventors: Hiroyuki Kimura, Obu (JP); Mitsutaka Kojima, Okazaki (JP); Kojiro Okada, Nagoya (JP); Kei Shigahara, Anjo (JP); Michihiro Hata, Okazaki (JP); Kazuhito Kawashima, Okazaki (JP); Kazuo Koga, Okazaki (JP); Kazuto Maehara, Anjo (JP); Hajime Ishii, Okazaki (JP)

(73) Assignees: Mitsubishi Jidosha Kogyo Kabushiki Kaisha, Tokyo (JP); Mitsubishi Jidosha Engineering Kabushiki Kaisha, Okazaki-Shi (JP)

( * ) Notice: Subject to any disclaimer, the term of this patent is extended or adjusted under 35 U.S.C. 154(b) by 0 days.

(21) Appl. No.: 12/267,317

(22) Filed: Nov. 7, 2008

(65) Prior Publication Data

US 2009/0158718 A1 Jun. 25, 2009

(30) Foreign Application Priority Data

Dec. 25, 2007 (JP) ..... 2007-332378

(51) Int. Cl.
*F01N 3/00* (2006.01)

(52) U.S. Cl. ..... 60/286; 60/295; 60/303

(58) Field of Classification Search ..... 60/286, 60/295, 303, 299, 324
See application file for complete search history.

(56) References Cited

U.S. PATENT DOCUMENTS

| | | | | |
|---|---|---|---|---|
| 5,605,042 | A * | 2/1997 | Stutzenberger | 60/286 |
| 6,401,449 | B1 * | 6/2002 | Hofmann et al. | 60/274 |
| 6,513,323 | B1 * | 2/2003 | Weigl et al. | 60/286 |
| 2008/0155973 | A1 * | 7/2008 | Maruyama et al. | 60/299 |

FOREIGN PATENT DOCUMENTS

| | | | |
|---|---|---|---|
| JP | 2003-83056 | A | 3/2003 |
| JP | 2005-127260 | A | 5/2005 |
| JP | 2005-214100 | A | 8/2005 |
| JP | 2005-214176 | A | 8/2005 |
| JP | 2006-77691 | A | 3/2006 |
| JP | 2008-151088 | A | 7/2008 |

* cited by examiner

*Primary Examiner* — Thomas E Denion
*Assistant Examiner* — Diem Tran
(74) *Attorney, Agent, or Firm* — Birch, Stewart, Kolasch & Birch, LLP

(57) ABSTRACT

An exhaust gas purification device for an internal combustion engine comprises, an exhaust passage including a catalyst for conveying exhaust gas discharged from the engine to the outside, and a bend formed by bending a portion of the exhaust passage directly upstream of the catalyst, the bend causing exhaust gas discharged from the engine to collide against a corner portion between an inlet end face of the catalyst and such portion of a wall of the exhaust passage that follows the outside of the bend, thereby increasing pressure at the corner portion, compared with the other portion of the inlet end face, and an additive injection valve fitted to the outside of the bend of the exhaust passage to inject an additive in such manner that the injected additive passes just above the corner portion and falls on the inlet end face of the catalytic converter.

4 Claims, 3 Drawing Sheets

EXHAUST GAS PURIFICATION DEVICE FOR INTERNAL COMBUSTION ENGINE

BACKGROUND OF THE INVENTION

1. Field of the Invention

This invention relates to an exhaust gas purification device for an internal combustion engine, configured to inject an additive to be supplied to a catalyst.

2. Description of the Related Art

In order to purify exhaust gas of diesel engine automobiles (vehicles), an exhaust gas purification device using an NOx trap catalyst, an NOx selective reduction catalyst, a particulate filter (diesel particulate filter) and/or the like in combination is used to prevent NOx (nitrogen oxides) and PM (particulate matter) in exhaust gas of the diesel engine from being emitted into the atmosphere.

For such exhaust gas purification devices, increasingly being adopted is a configuration in which a catalyst called a pre-stage catalyst, such as an oxidation catalyst or an NOx reduction catalyst (NOx trap catalyst or NOx selective reduction catalyst), is disposed in an exhaust passage for conveying exhaust gas discharged from the engine to the outside, and a fuel addition valve (reducing-agent addition valve) for injecting fuel as an additive required for reaction promoted by the catalyst is disposed upstream of the catalyst, for example, the oxidation catalyst.

In such exhaust gas purification devices, in order to enhance the purification efficiency in the cold state of the engine, the pre-stage catalyst is disposed near the exhaust side of the engine.

The space in the engine room is, however, limited. Thus, as shown in a patent gazette (Japanese Patent Laid Open No. 2005-127260), for example, there is a tendency to use an exhaust passage including a bend, for example an L-shaped bend to allow a pre-stage catalyst to be disposed directly downstream of the bend, and inject fuel from the outside of the bend toward an inlet end face of the catalyst, disposed directly downstream of the bend.

In this configuration, however, the flow of fuel injected from the outside of the bend toward the catalyst merges into exhaust gas passing through the bend, therefore curving, so that the fuel flow is liable to be constantly pushed from the inside to the outside of the bend by the exhaust gas passing through the bend.

Thus, in high-load operation of the engine with an increased flow volume and velocity of exhaust gas, the exhaust gas pushes the injected fuel flow from the inside of the bend with an increased force, so that the fuel flow deviates from a predetermined position on the inlet end face of the catalyst, for example from the center toward the side of the catalyst corresponding to the outside of the bend. In low-load operation of the engine with a decreased flow volume and velocity of exhaust gas, in contrast, the exhaust gas pushes the injected fuel flow with a decreased force, so that the fuel flow deviates toward the opposite side of the catalyst. Such deviation of the fuel flow directly reflects the operating state of the engine and is liable to become excessively great.

This leads to the problem that the fuel required for reaction fails to be supplied to the pre-stage catalyst in a desired direction, so that the catalytic converter using the pre-stage catalyst fails to show satisfactory performance.

SUMMARY OF THE INVENTION

The present invention has been made in view of the problems mentioned above. The primary object thereof is to provide an exhaust gas purification device for an internal combustion engine capable of preventing excessive deviation of flow of an injected additive.

An exhaust gas purification device for an internal combustion engine according to the present invention comprises an exhaust passage including a catalyst for conveying exhaust gas discharged from the internal combustion engine to the outside; a bend formed by bending a portion of the exhaust passage directly upstream of the catalyst, the bend causing exhaust gas discharged from the internal combustion engine to collide against a corner portion between an inlet end face of the catalyst and such portion of a wall of the exhaust passage that follows the outside of the bend, thereby increasing pressure at the corner portion, compared with the other portion of the inlet end face; and an additive injection valve fitted to the outside of the bend of the exhaust passage to inject an additive in such manner that the injected additive passes just above the corner portion and falls on the inlet end face.

When the exhaust gas flow in the exhaust passage has an increased velocity, thus pushing the flow of the injected additive from the inside of the bend with an increased force, deviation of the flow of the injected additive is liable to occur. However, an increased pressure is created at the corner portion between the inlet end face and the wall portion following the outside of the bend, and this increased pressure acts on the injected additive flow from the outside of the bend to curb deviation thereof. Thus, excessive deviation of the injected additive flow can be prevented. This allows the additive to be supplied to the catalyst in a desired direction. Consequently, the catalyst can show satisfactory performance.

In a preferred aspect of the present invention, the additive injection valve injects the additive in such manner that the injected additive passes just above the corner portion, obliquely, and falls on the inlet end face. This configuration ensures that the injected additive flow passes through a region where the pressure created at the corner portion acts on the injected additive flow effectively. In other words, this configuration enables most effective application of deviation-curbing force.

In a preferred aspect of the present invention, an additive injection passage is provided which has a proximal end joined to the outside of the bend of the exhaust passage and extends from the proximal end in the direction opposite to the direction of the additive injection, and the additive addition valve is disposed at a distal end of the additive injection passage. In this configuration, the addition valve is not directly exposed to the exhaust gas flow in the exhaust passage, thus protected from heat. Further, this configuration allows the addition valve to be disposed at a great distance from the inlet end face of the catalyst, which results in spray of the additive falling on the inlet end face with a momentum decreased to limit penetration.

In a preferred aspect of the present invention, the exhaust passage includes, between the bend and the inlet end face of the catalyst, an expanded portion whose flow passage area is gradually expanded from the bend toward the inlet end face. In this configuration, the expanded portion helps cause an increase in pressure at the corner portion, thereby enabling an increase in the force curbing the deviation of the injected additive flow. Further, the expanded portion decreases the flow velocity of exhaust gas, thereby facilitating merging of the additive and the exhaust gas.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

The present invention will be explained on the basis of an embodiment shown in FIGS. 1 to 3.

Figure 1:
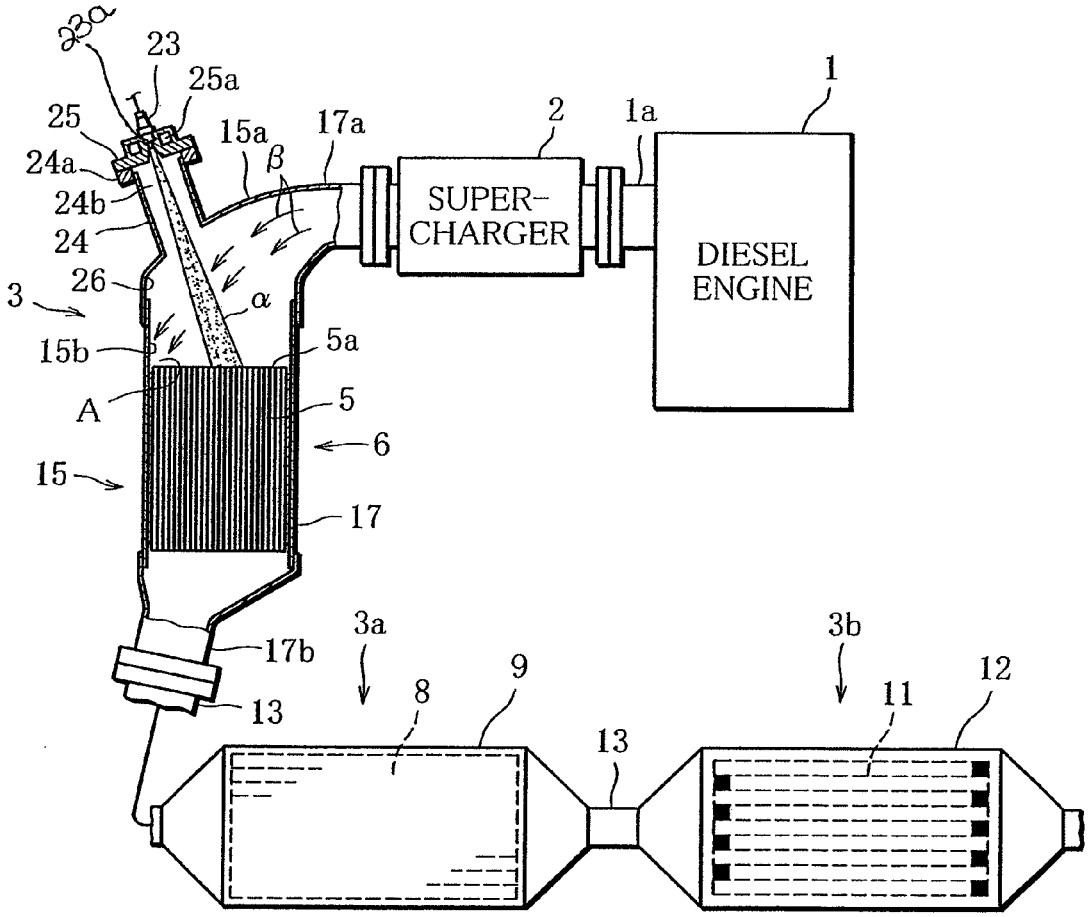
FIG. 1 is a side view showing an entire exhaust gas purification device according to an embodiment of the present invention.

FIG. 1 shows an exhaust system of a diesel engine. In FIG. 1, reference character 1 denotes an engine body of the diesel engine, 1*a* an exhaust manifold (shown only partly) connected to the engine body 1, and 2 a supercharger, for example a turbocharger, connected to the outlet of the exhaust manifold 1*a*.

At the exhaust outlet of the turbocharger 2, an exhaust gas purification device 3 is provided. The exhaust gas purification device 3 is, for example, a device composed of a combination of an NOx removal system 3*a* designed to adsorb NOx (nitrogen oxides) in exhaust gas and periodically reduce the adsorbed NOx, thereby removing NOx, and a PM trap system 3*b* designed to trap PM (particulate matter).

The NOx removal system 3*a* is, for example, composed of a combination of a catalytic converter 6 having an oxidation catalyst 5 serving as a pre-stage catalyst, connected to extend downward from the exhaust outlet of the turbocharger 2, a catalytic converter 9 having an NOx trap catalyst 8, connected after the catalytic converter 6 to extend sideways, and a valve 23 serving as an additive injection valve supplying fuel (additive) to the oxidation catalyst 5 for catalyzed reaction, which will be described later. The trap system 3*b* is composed of a catalytic converter 12 including a particulate filter 11, which is connected to the catalytic converter 9. These catalytic converters 6, 9, 12, parts 13 connecting the catalytic converters to each other, etc. constitute an exhaust passage 15 for conveying exhaust gas discharged from the engine body 1 of the diesel engine to the outside.

An upright cylindrical housing 17 enclosing the catalytic converter 6 having the oxidation catalyst 5 has an upper portion formed into an approximate L shape, where an inlet 17*a* connected to the turbocharger 2 disposed at a higher position faces almost sideways, while an outlet 17*b* connected to the catalytic converter 9 faces downward. The housing 17 provides an L-shaped bend 15*a* of the exhaust passage 15, immediately after the exhaust side of the diesel engine. Immediately beneath the bend 15*a*, a space for a catalytic converter is prepared, in which space the catalytic converter having the oxidation catalyst 5 is disposed.

The fuel addition valve 23 is disposed just above the oxidation catalyst 5, for example fitted to the wall of the bend 15*a* on the outside of the bend, to inject fuel to the oxidation catalyst 5 for catalyzed reaction. The fuel addition valve 23 has, at a distal end, a fuel injection portion 23*a* through which fuel is injected. The fuel addition valve 23 is fitted to a fitting flange 24*a* provided at a distal end of a cylindrical member 24 branching off the bend 15*a* on the outside of the bend, by means of a base seat 25. The fuel injection portion at the distal end of the fuel addition valve 23 faces the interior of the cylindrical member 24 serving as a fuel injection passage 24*b*. The cylindrical member 24 has a proximal end joined to the outside of the bend 15*a* of the exhaust passage 15, and extends from the proximal end in the direction opposite to the direction of flow α of injected fuel, which will be described later. This allows the fuel addition valve 23 to be located away from an exhaust gas flow in the bend 15*a*, thereby preventing the fuel injection portion 23*a* from being exposed to the high-temperature exhaust gas flow, thereby preventing the fuel addition valve 23 from exceeding its allowable temperature limit or rising to temperatures liable to produce deposits. In order to help prevent overtemperature, a coolant passage 25*a* is formed in the seat 25 to cool the fuel addition valve with a coolant.

As indicated by arrows β in FIG. 1, the bend 15*a* of the exhaust passage 15 is so curved as to guide exhaust gas from the inlet 17*a* to a corner portion A between an inlet end face 5*a* of the catalytic converter having the oxidation catalyst 5 and the wall portion following the outside of the bend 15*a* (i.e., that portion of the wall of the exhaust passage which follows the outside of the bend). During the operation of the diesel engine, such curvature causes exhaust gas to collide against the corner portion A, thereby creating higher pressure at the corner portion A, compared with the other portion of the inlet end face 5*a*.

The fuel addition valve 23 is disposed to inject fuel from the outside of the bend 15*a* in such manner that the injected fuel passes just above the corner portion A and falls on a predetermined position on the inlet end face 5*a* of the oxidation catalyst 5, for example the center of the inlet end face 5*a*. Specifically, the orientation of the fuel injection valve 23 is determined such that the flow α of the injected fuel passes just above the corner portion A, obliquely. More specifically, the injected fuel flow α slants from the axis (not shown) of the catalyst 5, to the side opposite to the exhaust gas flow β slants. This allows the pressure created at the corner portion to act on the injected fuel flow α as a force pushing it from the outside of the bend 15*a*, namely a force against the force pushing the injected fuel flow α from the inside of the bend 15*a* and causing deviation of the injected fuel flow α.

The portion of the exhaust passage between the bend 15*a* and the inlet end face 5*a* of the catalyst 5 is gradually increased in flow passage area, from the outlet of the bend 15*a* toward the inlet end face 5*a*, to form an expanded portion 26 with an expanded flow passage area, before the oxidation catalyst 5. The expanded portion 26 facilitates creation of a pressure to be exerted on the injected fuel flow α. Needless to say, the expanded portion 26 also has a function of decreasing the flow velocity of exhaust gas, thereby facilitating the merging of fuel and exhaust gas.

The fuel injected by the fuel addition valve 23 is used for generating a reducing agent by reaction of the oxidation catalyst 5 to reduce and remove NOx and SOx adsorbed on the NOx trap catalyst 8, and to burn and remove the PM trapped on the particulate filter 11 by heat obtained similarly by the reaction of the oxidation catalyst 5. Thus, during the operation of the diesel engine, the fuel addition valve 23 is controlled by a control device controlling the diesel engine, for example an ECU (not shown) to inject fuel when catalyzed reaction is required for removal of NOx and SOx by reduction, burning-off of PM or the like.

Next, the function of the exhaust gas purification device 3 configured as described above will be described on the basis of FIGS. 1 to 3.

As shown in FIG. 1, during the operation of the diesel engine, exhaust gas discharged from the diesel engine is emitted into the outside air, after passing through the exhaust manifold 1*a*, the turbocharger 2, the housing 17, the catalytic converter having the oxidation catalyst 5, the catalytic converter having the NOx trap catalyst 8, and the particulate filter 11.

NOx in the exhaust gas is adsorbed on the NOx trap catalyst 8, while PM in the exhaust gas is trapped on the particulate filter 11.

Suppose that the removal of adsorbed NOx and/or trapped PM becomes necessary and the fuel addition valve 23 is operated.

Figure 2:
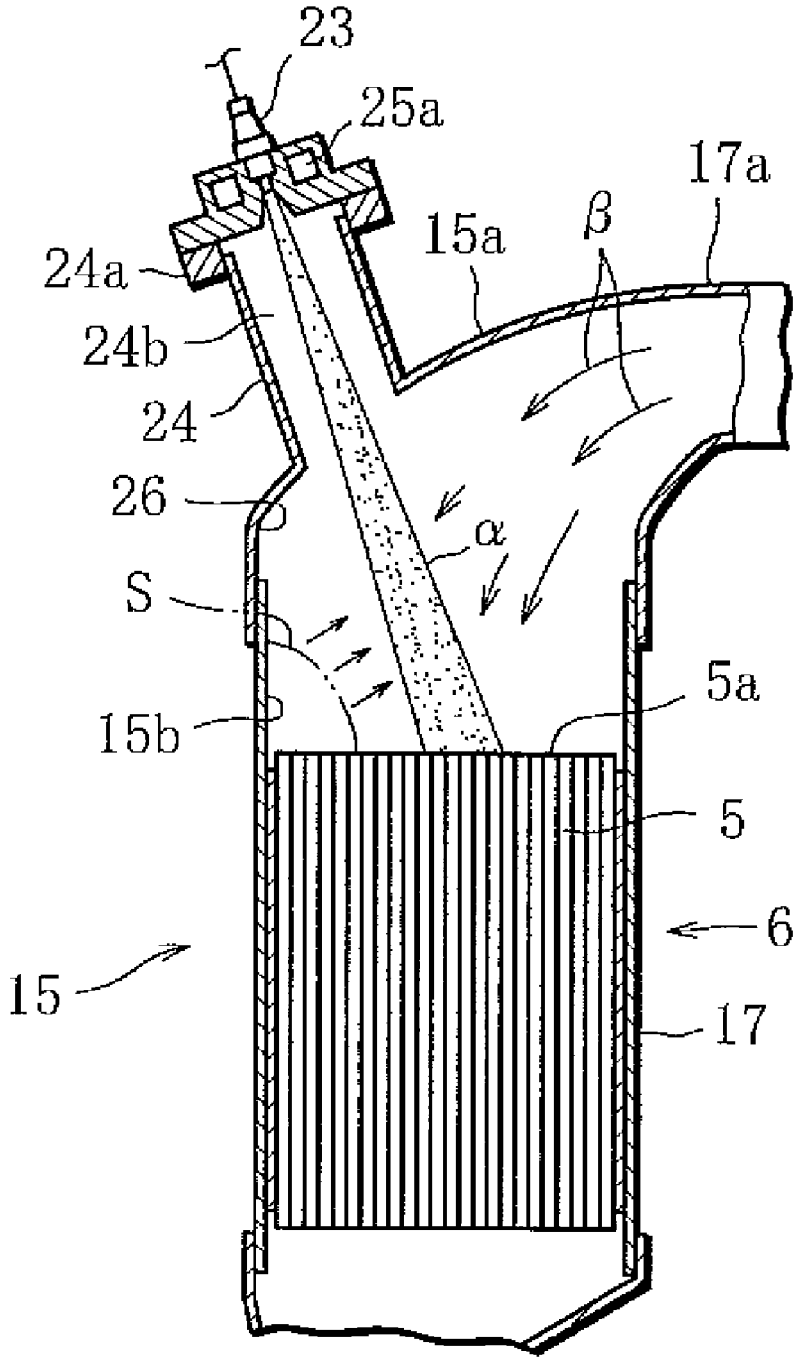
FIG. 2 is a vertical cross-sectional view for explaining the state in low-load operation of an engine.

As shown in FIGS. 1 and 2, fuel required for removal of NOx and PM is injected from the fuel injection portion of the fuel addition valve 23 into the fuel injection passage 24*b*, toward the center of the inlet end face 5*a* of the oxidation catalyst 5. Reference character a denotes the flow of the injected fuel.

Figure 3:
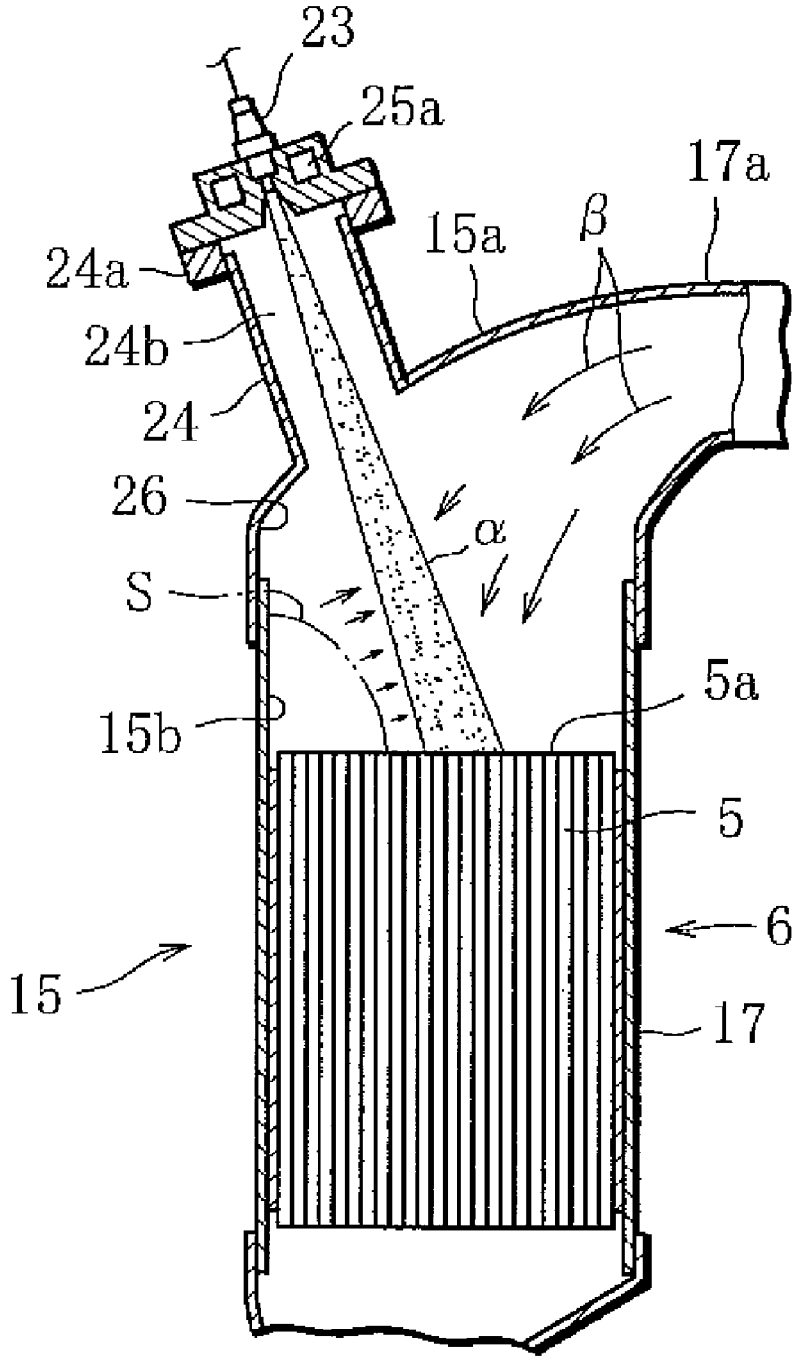
FIG. 3 is a vertical cross-sectional view for explaining the state in high-load operation of the engine.

As shown in FIGS. 2 and 3, the flow α of the injected fuel is pushed sideways, namely pushed from the inside of the bend 15*a* by the flow β of exhaust gas passing through the bend 15*a*.

The force with which the exhaust gas flow β pushes the injected fuel flow α is small when the diesel engine is in low-load operation with a small flow volume and velocity of exhaust gas, as shown in FIG. 2, and great when the diesel engine is in high-load operation with an increased flow volume and velocity of exhaust gas, as shown in FIG. 3.

During the operation of the engine, a high-pressure region S is created at and near the corner portion A, on the side corresponding to the outside of the bend 15*a*, by the exhaust gas colliding against the corner portion A after having passed through the bend 15*a*.

The high-pressure region S shows variation depending on the operating state of the diesel engine, such that it rises in pressure with an increase in flow volume and velocity of exhaust gas as shown in FIG. 3, and drops in pressure with a decrease in flow volume and velocity of exhaust gas as shown in FIG. 2.

Here, since the injected fuel flow α passes just above the corner portion A, pressure created at the corner portion A acts on the injected fuel flow α from the outside of the bend 15*a*.

Regardless of whether the diesel engine is in low-load operation or in high-load operation, the injected fuel flow α is liable to deviate by being pushed by the exhaust gas flow β from the inside of the bend 15*a*. However, the pressure created at the corner portion A acts from the outside of the bend 15*a* to push the injected fuel flow α, thereby curbing deviation of the injected fuel flow α.

Thus, no matter what operating state the diesel engine is in, forces equivalent in magnitude act on the injected fuel flow α from the inside and outside of the bend 15*a*, so that excessive deviation is prevented.

Thus, the injected fuel flow α does not exhibit excessive deviation, or in other words, the injected fuel flow α can be almost maintained in a predetermined direction. This results in uniform supply of fuel to the oxidation catalyst 5 for reaction, so that the catalytic converter using the oxidation catalyst 5 can show satisfactory performance.

Further, the injected fuel flow α is caused to pass just above the corner portion A, obliquely, so as to receive the pressure created at the corner portion A, effectively. In other words, it is arranged such that deviation-curbing force is applied to the injected fuel flow α most effectively.

This deviation-curbing arrangement is suited and convenient particularly for the configuration in which the fuel addition valve 23 is disposed away from the exhaust gas flow to allow the injected fuel a sufficient flying distance, thereby causing the fuel to fall on the inlet end face 5*a* of the catalytic converter having the oxidation catalyst 5, with a momentum decreased to limit penetration.

Further, providing the portion between the outlet of the bend 15*a* and the oxidation catalyst 5 as an expanded portion 26 with gradually expanded flow passage area helps produce a satisfactory effect by facilitating the creation of a force curbing the deviation of the injected fuel flow α at the corner portion.

The present invention is not restricted to the above-described embodiment, but can be modified in various ways without departing from the spirit and scope of the present invention. For example, in the described embodiment, the present invention is applied to an exhaust gas purification device in which an oxidation catalyst is disposed directly downstream of the bend, and an NOx trap catalyst and a particulate filter are disposed downstream thereof. The present invention is, however, not restricted to this, but can be applied to exhaust gas purification devices intended for another purification procedure, such as an exhaust gas purification device in which an NOx trap catalyst is disposed directly downstream of the bend, a particulate filter is disposed downstream thereof, and an addition valve is disposed upstream of the NOx trap catalyst, or an exhaust gas purification device in which an NOx trap catalyst is disposed directly downstream of the bend, an oxidation catalyst and a particulate filter are disposed downstream thereof, and an addition valve is disposed upstream of the NOx trap catalyst, or an exhaust gas purification device in which a selective reduction catalyst and a particulate filter are disposed directly downstream of an additive injection valve.

Further, although in the described embodiment, fuel is used as an additive, the additive may be any substance to be supplied to a catalyst. For example, the additive may be a reducing agent, such as light oil, gasoline, ethanol, dimethyl ether, natural gas, propane gas, urea, ammonia, hydrogen or carbon monoxide, or a substance not being a reducing agent, such as air, nitrogen or carbon dioxide used for cooling a catalyst, or air or ceria used for promoting burning-off of soot trapped on a particulate filter.

What is claimed is:

1. An exhaust gas purification device for an internal combustion engine, comprising:

an exhaust passage including a catalyst for conveying exhaust gas discharged from the internal combustion engine to the outside, the exhaust passage further including a bend formed by bending a portion of the exhaust passage directly upstream of the catalyst, the bend causing exhaust gas discharged from the internal combustion engine to collide against a corner portion between an inlet end face of the catalyst and such portion of a wall of the exhaust passage that follows the outside of the bend, thereby increasing pressure at the corner portion, compared with the other portion of the inlet end face; and an additive injection valve fitted to the outside of the bend of the exhaust passage to inject an additive in such manner that the injected additive passes across and just above the corner portion, in a direction from the outside toward the inside of the bend, and falls on the inlet end face, wherein a direction of a center axis of a range, within which the injected additive flows, intersects a center axis of the exhaust passage and the inlet end face, and the bend has an outlet portion whose flow passage area is gradually expanded toward the inlet end face of the catalyst.

2. The exhaust gas purification device for the internal combustion engine according to claim 1, wherein the catalyst is disposed to be in contact with an outlet end of the bend.

3. The exhaust gas purification device for the internal combustion engine according to claim 1, wherein the additive injection valve is disposed away from the flow of exhaust gas in the bend.

4. An exhaust gas purification device for an internal combustion engine, comprising:

an exhaust passage including a catalyst for conveying exhaust gas discharged from the internal combustion engine to the outside, the exhaust passage further including a bend formed by bending a portion of the exhaust passage directly upstream of the catalyst, the bend causing exhaust gas discharged from the internal combustion engine to collide against a corner portion between an inlet end face of the catalyst and such portion of a wall of the exhaust passage that follows the outside of the bend, thereby increasing pressure at the corner portion, compared with the other portion of the inlet end face; and an additive injection valve fitted to the outside of the bend of the exhaust passage to inject an additive in such manner that the injected additive passes across and just above the corner portion, in a direction from the outside toward the inside of the bend, and falls on the inlet end face, wherein the inlet end face of the catalyst, facing the bend, is positioned within the exhaust passage, such that a center axis of a range, within which the injected additive flows, extends in a direction oblique to a center axis of the catalyst and intersects with the inlet end face.

* * * * *